United States Patent [19]

Gibbs

[11] 4,330,333

[45] May 18, 1982

[54] HIGH TITANIUM NITRIDE CUTTING MATERIAL

[75] Inventor: Norman R. Gibbs, Birmingham, Mich.

[73] Assignee: The Valeron Corporation, Madison Heights, Mich.

[21] Appl. No.: 182,383

[22] Filed: Aug. 29, 1980

[51] Int. Cl.[3] ..... B22F 3/12; B22F 7/06

[52] U.S. Cl. ..... 75/244; 75/238; 75/236; 75/203; 75/205; 407/119

[58] Field of Search ..... 75/238, 236, 244, 203, 75/205, 134 V; 407/119

[56] References Cited

U.S. PATENT DOCUMENTS

| | | | |
|---|---|---|---|
| 3,669,695 | 6/1972 | Iler | 75/203 |
| 3,752,655 | 8/1973 | Ramquist | 75/205 |
| 3,971,656 | 7/1976 | Rudy | 75/205 |
| 4,065,301 | 12/1977 | Tanaka | 75/205 |
| 4,120,719 | 10/1978 | Nomura | 75/238 |

FOREIGN PATENT DOCUMENTS

| | | |
|---|---|---|
| 50-102507 | 8/1975 | Japan . |
| 55-14878 | 2/1980 | Japan . |
| 55-91955 | 7/1980 | Japan . |

*Primary Examiner*—Brooks H. Hunt
*Assistant Examiner*—J. J. Zimmerman
*Attorney, Agent, or Firm*—Robert S. Alexander

[57] ABSTRACT

A cutting tool material having a surprising combination of toughness, high speed wear resistance, strength, resistance to chipping, and resistance to thermal fatigue, consisting essentially of: 15 to 25% of a nickel cobalt binder; 3 to 6% molybdenum carbide; 2 to 5% VC; 15 to 25% TiC; 30 to 40% TiN; and 15 to 20% WC by weight.

1 Claim, No Drawings

HIGH TITANIUM NITRIDE CUTTING MATERIAL

Metalworking materials should combine toughness, wear resistance and resistance to thermal shock and fatigue. While obtaining high levels of either toughness or wear resistance is not especially difficult, optimum combinations of the two remain elusive. In many applications such as numerically controlled machining, when the choice has to be made, wear resistance will be sacrificed for toughness because it is relatively difficult to predict when the first chip will occur but wear tends to follow a more uniform course. Further, if the tool chips or breaks, the part will be ruined and the tool must be changed, but programs are available to compensate for reasonable degrees of wear during machining.

Titanium carbide cemented with molybdenum and nickel is often used in applications which require wear resistance in high speed cutting combined with a reasonable degree of toughness. However this low strength material is somewhat brittle and has relatively low thermal shock resistance so its use has been limited in interrupted cuts. One approach to improving the properties of this material has been to substitute tungsten carbide and tantalum carbide for a portion of the titanium carbide. This increases the strength but has not sufficiently increased the toughness to allow this material to be used in heavy interrupted cuts.

A still further improvement has been achieved by substituting titanium nitride for titanium carbide. This approach has resulted in significant increases in strength, wear resistance and toughness so long as the maximum amount of titanium nitride was limited to about 20 weight percent. At higher levels, the material properties were somewhat degraded. In particular, the prior art indicates that further addition of titanium nitride seemed to embrittle the material.

The present invention relates to a cutting tool material incorporating in excess of 25% titanium nitride which does not exhibit the embrittlement reported for the prior art high titanium nitride cutting tools. More particularly, the present invention relates to cutting tool material consisting essentially of:

- from about 30 to about 40 weight percent titanium nitride;
- from about 15 to about 25 weight percent titanium carbide;
- from about 15 to about 20 weight percent tungsten carbide;
- from about 15 to about 25 weight percent of a mixture of nickel and cobalt, the weight ratio of nickel to cobalt being between about 0.8 and about 1.2;
- from about 2 to about 5 weight percent vanadium carbide; and
- from about 3 to about 6 weight percent molybdenum carbide.

Throughout the specification, the term "molybdenum carbide" is to be understood as any of the compounds $Mo_2C$, MoC, mixtures thereof or the reaction product formed by the addition of molybdenum and carbon in an atomic ratio between about one to one and about two to one respectively whether all of the molybdenum actually reacts with the carbon or a portion of it is dispersed through the binder phase.

This material exhibits a surprisingly useful combination of toughness, wear resistance, thermal shock and fatigue resistance, hot strength and resistance to chipping. This material is particularly useful for cutting cast iron, steel, and stainless steels in applications requiring at least moderate toughness and resistance to chipping combined with high wear resistance at high speeds. Milling is a typical example of such an application.

The preparation of the composition of the present invention is achieved by providing the several constituents in the form of fine-sized powders of an average particle size usually less than about 10 microns, and preferably of an average size less than about 5 microns. The manners by which the powders can be comminuted to the requisite particle size are well known and can be achieved in accordance with prior art techniques. Typical of such techniques are those disclosed in U.S. Pat. No. 3,542,529, the substance of which is incorporated herein by reference.

Carefully measured amounts of the powder constituents within the permissible ranges are suitably blended to form a substantially uniform mixture whereafter a blank is formed by cold pressing and sintering in a vacuum or in a protective atmosphere, such as nitrogen, in accordance with known prior art practices.

To facilitate consolidating the blank by cold pressing, and sintering, a small amount of paraffin is usually included in the powdered composition prior to pressing. The amount included is usually between about 2 and about 5% by weight. After cold pressing, the blank is preferably vacuum sintered in accordance with well known prior art sintering techniques. Temperatures of between about 2500° F. and about 2800° F. are generally useful for these compositions. Care should be taken to avoid excessive loss of nitrogen or carbon during sintering. In the event that a large amount of titanium nitride is lost during sintering, a protective atmosphere of nitrogen may be used. Excessive loss of carbon is generally due to inadvertent introduction of oxygen into the sintering furnace. This problem is preferably controlled by diligent attention of the processing step to preclude oxygen pick up. In particular, the mix should be vacuum dryed after milling.

To a certain extent deficiencies in processing which cause carbon loss may be counterbalanced by including a compensating amount of free carbon in the unsintered inserts but this is generally considered a stop gap measure.

Typically, the blanks are pressed into a shape roughly equivalent to the desired shape then after sintering are ground to finished configuration. After finish grinding, the consolidated inserts produced are readily adaptable for a variety of cutting tool and cutting tool insert applications including turning, facing, boring, milling, and the like. The cutting tool blanks can readily be fabricated in a variety of geometries in accordance with known cutting tool configurations to provide for optimum cutting efficiency in accordance with its intended end use.

In order to further demonstrate the superiority of cutting tools and inserts composed of the material of the present invention, a series of machining tests including tool wear tests were conducted in comparison to prior art cutting tool materials. Throughout this application, materials tested were in the form of a cutting tool insert having a standard TNG 333 shape with 0.003 inch by 30° chamfers. Where compositions of the present invention are formed into inserts, unless stated to the contrary, it is to be understood that these were cold pressed and sintered in vacuo at about 2700° F. then examined to verify that the inserts were substantially fully dense without deleterious porosity. It is also to be understood that approximately 4% paraffin (by weight) was added to the powdered mix. In some cases, inserts which did not appear to be fully dense were resintered, then tested.

EXAMPLE I

To demonstrate the unusual combination of wear resistance and toughness of the cutting materials of the present invention, inserts having compositions as set forth in Table I were tested in facing a type 4150 as cost steel bar (Rockwell "C" hardness of 20) from 7" down to about 2¾" at a feed of 0.016 inches per revolution and an initial cutting speed of 1100 surface feet per minute. The inserts were periodically examined for wear, chipping and the appearance of the first thermal crack. Those inserts which did not survive for an appreciable time at 1100 surface feet per minute were retested at 900 and 710 surface feet per minute. A competitive insert believed to be substantially of the composition NA or NB was also tested and is reported as insert "T". Table II reports the transverse rupture strength of each of the inserts in thousands of pounds per square inch as well as the highest cutting speed which it survived in feet per minute, whether the insert failed by chipping or by wear, the number of cuts survived before the appearance of the first thermal crack in the cutting edge, and the number of cuts survived before the cutting edge was "chipped out" or the wear land had reached over 0.015 inch. It is significant to note that of the inserts tested only the cutting material of the present invention as exemplified by insert "R" survived cutting speeds of 1100 surface feet per minute, did not exhibit thermal cracking and failed by wear.

EXAMPLE II

To demonstrate the impact resistance of the cutting materials of the present invention, inserts as set forth in Table I were tested to face mill pre-machined Hyten B3X (modified A151 4150) steel 1½ by 3 inches (Rockwell "C" hardness of 20-21) using a fly cutter at 920 surface feet per minute, 0.125" depth of cut with the entry face of the bar on the centerline of the cutter. Various feeds were used as set forth in Table III wherein a "P" indicates that the insert survived the test in good condition, an "F" indicates that the insert fractured or chipped and an "M" indicates that insert survived the test but exhibited thermal crack damage and was near failing.

TABLE I

| | Ni | Co | Mo | TaC | WC | TiC | C | VC | TiN |
|---|---|---|---|---|---|---|---|---|---|
| G | 7.0 | 3.0 | 10.0 | 0.5 | 10.0 | 69.5 | .7 | — | — |
| H | 7.0 | 3.0 | 10.0 | 0.5 | 12.0 | 67.5 | 0.7 | — | — |
| J | 12.4 | — | 10.9 | — | — | 76.0 | 0.7 | — | — |
| X | 17.9 | — | 8.9 | — | — | 72.5 | 0.7 | — | — |
| L | 20.9 | — | 8.9 | — | — | 69.5 | 0.7 | — | — |
| M | 25.0 | — | 10.0 | — | — | 47.5 | — | 10.0 | 7.5 |
| NA | 7.0 | 3.0 | 10.0 | 0.5 | 10.0 | 52.1 | — | — | 17.4 |
| NB | 7.0 | 3.0 | 10.0 | 0.5 | 10.0 | 51.5 | 0.6 | — | 17.4 |
| O | 17.5 | 7.5 | 10.0 | 0.5 | 8.0 | 41.9 | 0.6 | — | 14.0 |

TABLE I-continued

| | Ni | Co | Mo | TaC | WC | TiC | C | VC | TiN |
|---|---|---|---|---|---|---|---|---|---|
| P | 10.0 | — | 10.0 | — | — | 58.1 | 0.6 | 12.2 | 9.1 |
| Q | 5.5 | 5.0 | 10.0 | — | 10.0 | 48.25 | 1.25 | 2.0 | 18.0 |
| R | 10.0 | 9.0 | 4.5 | — | 18.0 | 22.0 | 0.5 | 3.5 | 32.5 |
| S | 11.0 | 10.0 | 8.4 | — | 9.5 | 40.5 | 1.1 | 2.0 | 17.5 |

TABLE II

| | TRS | SFM | Mode | First TC | Life |
|---|---|---|---|---|---|
| G | 152 | 1100 | chip | 14 | 31 |
| H | 162 | 1100 | chip | 14 | 29 |
| J | 179 | 1100 | wear | 13 | 18 |
| K | 241 | 710 | wear | — | 6 |
| L | 288 | 710 | wear | — | 2½ |
| M | 253 | 900 | wear | — | 7 |
| NA | 213 | 1100 | chip | 32 | 22,36 |
| NB | 190 | 1100 | chip | — | 24,38 |
| O | 274 | 710 | wear | — | 1 |
| P | 115 | 1100 | chip | — | 5,16 |
| Q | 245 | 1100 | chip | — | 24,40 |
| R | 278 | 1100 | wear | — | 27 |
| S | 280 | 900 | wear | — | 10 |
| T | 240 | 1100 | chip | — | 23 ave. |

TABLE III

| | Feed Inches per Minute | | | | |
|---|---|---|---|---|---|
| | 3¾ | 4½ | 5-/14 | 6½ | 7½ |
| G | | P | P | F | |
| H | | P | P | M | |
| J | | P | M | F | |
| K | | | P | P | M |
| L | | | | P | M |
| M | | | P | M | |
| NA | | P | P | F | |
| NB | | P | F | | |
| O | | | | P | M |
| P | P | F | | | |
| Q | P | F | | | |
| R | | | P | F | |
| S | | | P | M | |
| T | | P | P | M | |

Thus it can be seen that the cutting materials of the present invention as typified by inserts "R" exhibit a surprising combination of high speed wear resistance, strength, toughness, resistance to chipping, and resistance to thermal fatigue.

As our invention, we claim:

1. A powder metallurgical sintered cutting tool insert consisting essentially of:

from about 15 to about 25 percent by weight of a nickel cobalt alloy, the ratio of nickel to cobalt being between about 0.8 and about 1.2;

from about 3 to about 6 percent by weight of a molybdenum carbide;

from about 2 to about 5 percent by weight of vanadium carbide;

from about 15 to about 25 percent by weight of titanium carbide;

from about 30 to about 40 percent by weight of titanium nitride; and from about 15 to about 20 percent by weight of tungsten carbide.

* * * * *